US006682160B2

(12) United States Patent
Kung

(10) Patent No.: US 6,682,160 B2
(45) Date of Patent: Jan. 27, 2004

(54) DRAWER SLIDING STRUCTURE

(75) Inventor: Yung Sheng Kung, Ying-Ge (TW)

(73) Assignee: Nan Juen International Co., Ltd. (TW)

( * ) Notice: Subject to any disclaimer, the term of this patent is extended or adjusted under 35 U.S.C. 154(b) by 0 days.

(21) Appl. No.: 10/123,178

(22) Filed: Apr. 17, 2002

(65) Prior Publication Data

US 2003/0197452 A1 Oct. 23, 2003

(51) Int. Cl.[7] ..... A47B 88/00

(52) U.S. Cl. ..... 312/334.6; 312/334.12; 312/334.15

(58) Field of Search ..... 312/334.6, 334.12, 312/334.7, 334.8, 334.14, 334.15, 334.18, 334.27, 334.28, 334.31, 334.32, 334.39; 248/430, 298.1; 384/18–23

(56) References Cited

U.S. PATENT DOCUMENTS 4,465,324 A * 8/1984 Rock ..... 308/3.8
4,752,143 A * 6/1988 Lautenschlager, Jr. ..... 384/19
5,344,227 A * 9/1994 Rock ..... 312/334.6
5,344,228 A * 9/1994 Kovarik ..... 312/334.9
5,769,518 A 6/1998 Grabher ..... 312/334.6
6,132,020 A * 10/2000 Schael ..... 312/334.1
6,347,849 B1 * 2/2002 Muterthies et al. .... 312/334.12

FOREIGN PATENT DOCUMENTS

DE 39 36 754 A1 * 11/1989

* cited by examiner

*Primary Examiner*—Gwendolyn Baxter
(74) *Attorney, Agent, or Firm*—Bacon & Thomas, PLLC

(57) ABSTRACT

A drawer sliding structure includes a track seat, an outer slide rail, and an inner slide rail. The track seat is fastened to the panel of a cabinet or the like and is provided with a guide portion. The outer slide rail is fastened with a drawer of the table. The inner slide rail is slidably fastened with the guide portion of the track seat in conjunction with a first roller seat. The outer slide rail is mounted on the inner slide rail in conjunction with a second roller seat which is provided with at least two vertical rollers and at least one horizontal roller, with the vertical rollers and the horizontal roller being located between the outer slide rail and the inner slide rail.

6 Claims, 2 Drawing Sheets

DRAWER SLIDING STRUCTURE

FIELD OF THE INVENTION

The present invention relates generally to a sliding drawer in a cabinet, table, bureau, etc., and more particularly to a durable structure for sliding the drawer without making noise.

BACKGROUND OF THE INVENTION

U.S. Pat. No. 5,769,518 discloses a drawer sliding structure which comprises a plurality of rail elements, rail-supporting elements, and rolling elements. This prior art structure is defective in design in that it makes noise at the time when the drawer is pushed back into place after being drawn out. In addition, the rolling elements of this prior art structure are apt to collide with the panel of the table when the drawer is pushed back into place. Such violent contact between the rolling elements and the table panel often results in damage of not only the rolling elements but also the table panel. This prior art structure is further defective in design in that the drawerits rail is supported by two bearings which are mounted separately and are vulnerable to damage by an overloaded drawer.

SUMMARY OF THE INVENTION

The primary objective of the present invention is to provide a drawer sliding structure which is durable and quiet in operation.

In keeping with the principle of the present invention, the foregoing objective of the present invention is attained by a drawer sliding structure comprising a track seat adapted to be fastened at one side with a panel of a cabinet or the like, said track seat being provided with a vertical flange and a horizontal guide portion extending from one end of said vertical flange;

an outer slide rail having an inverted U-shaped cross section, a horizontal top side, two vertical sides, and an open side, with said horizontal top side being fastened with an underside of a bottom plate of a drawer of the cabinet or the like such that said open side of said outer slide rail faces a floor;

an inner slide rail having an inverted U-shaped cross section, a horizontal top side, two vertical sides, and an open side; and a first roller seat for fastening slidably said inner slide rail to said horizontal guide portion of said track seat such that said open side of said inner slide rail faces the floor;

wherein the improvement comprises said drawer sliding structure further comprises a second roller seat for mounting said outer slide rail on said inner slide rail, said second roller seat having an inverted U-shaped cross section, a horizontal top side, two vertical sides, and an open side, with said two vertical sides being provided with one vertical roller, and with said horizontal top side being provided with a horizontal roller, so that said second roller seat is mounted on said inner slide rail with said open side of said second roller seat facing the floor, and that said vertical roller and said horizontal roller are located between said outer slide rail and said inner slide rail, and further that said vertical roller and said horizontal roller provide rolling frictions between said outer slide rail and said inner slide rail.

Preferably, each of said two vertical sides of said second roller seat is provided with a plurality of vertical rollers; and said horizontal top side of said second roller seat is provided with a plurality of horizontal rollers.

Preferably, said second roller seat is made of a plastic material and is provided with at least one gap serving to interrupt transmission of a shock exerting on said second roller seat.

The features and the advantages of the present invention will be more readily understood upon a thoughtful deliberation of the following detailed description of a preferred embodiment of the present invention with reference to the accompanying drawings.

DETAILED DESCRIPTION OF THE PREFERRED EMBODIMENT

Figure 1:
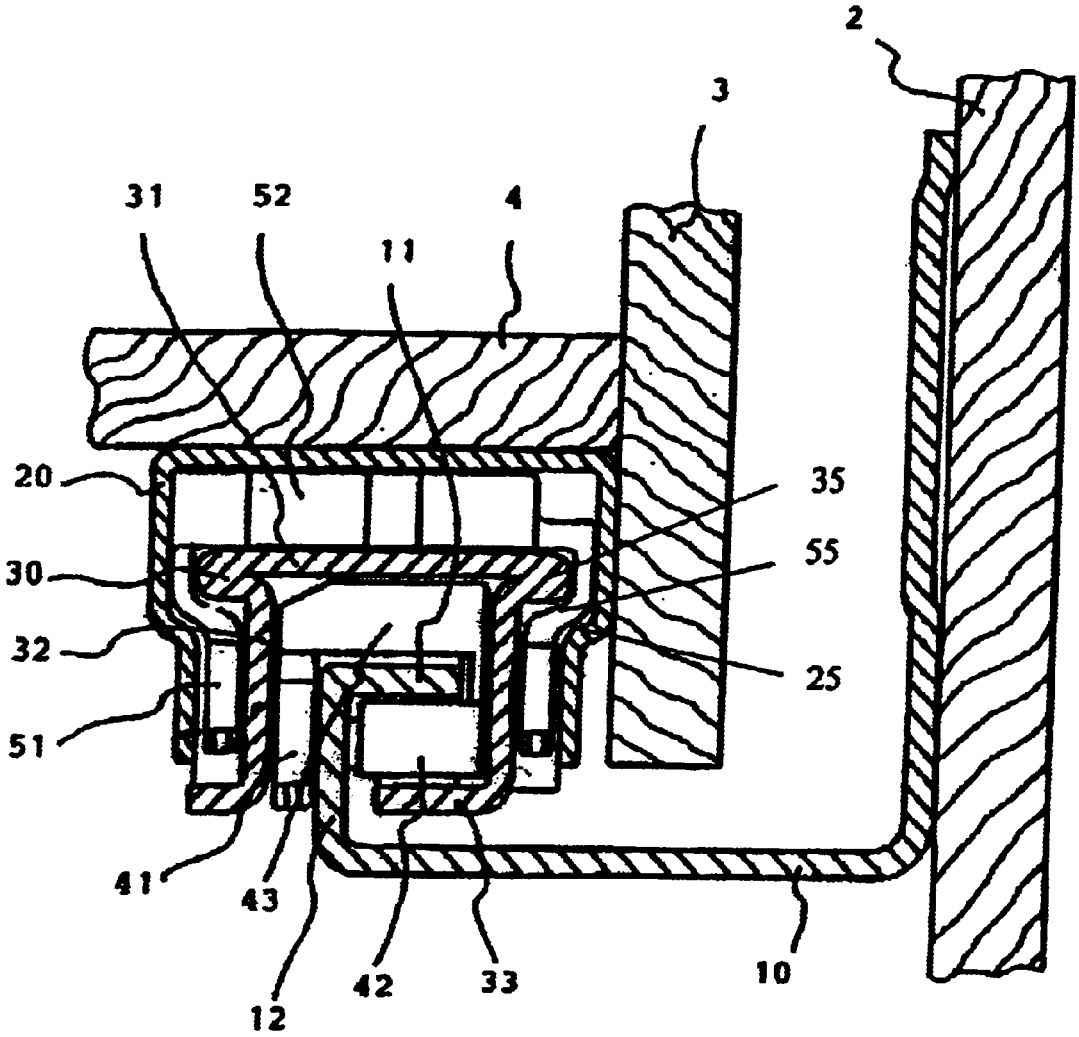
FIG. 1 shows a cross-sectional view of the preferred embodiment of the present invention.
Figure 2:
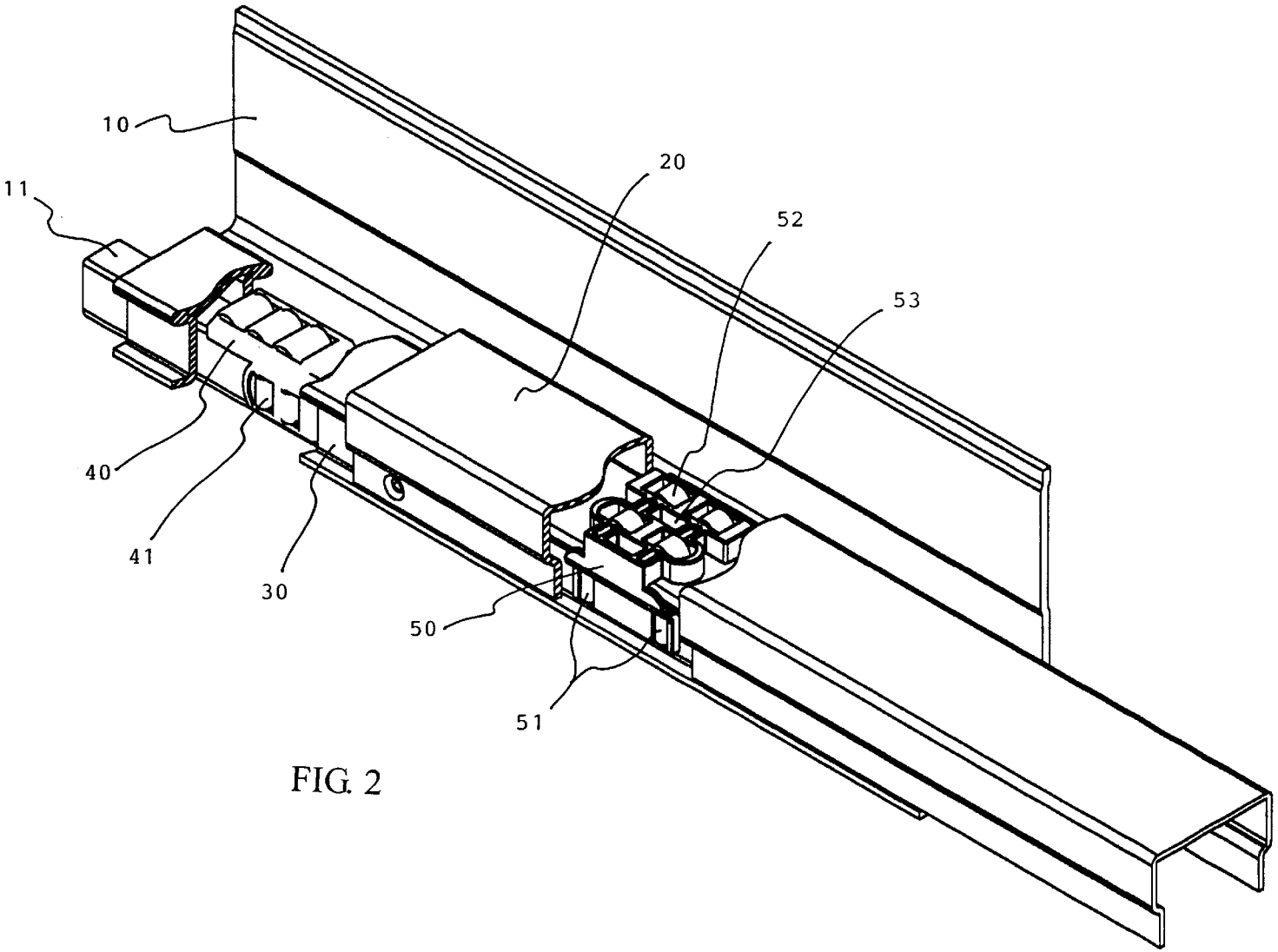
FIG. 2 shows a perspective view the preferred embodiment of the present invention shown in FIG. 1 exposing partial inside portions thereof.

As show in FIGS. 1 and 2, a drawer sliding structure embodied in the present invention comprises a track seat 10, an outer slide rail 20, and an inner slide rail 30.

The track seat 10 has a J-shaped cross section. The track seat 10 is provided at one end with a horizontal guide portion 11 and a vertical flange 12. The track seat 10 is fastened at an upright side with a panel 2 of the cabinet or the like, as shown in FIG. 1.

The outer slide rail 20 has an inverted U-shaped cross section. The outer slide rail 20 is fastened at the horizontal top thereof with an underside of a bottom plate 4 of a drawer 3 such that the open side of the outer slide rail 20 faces the floor.

The inner slide rail 30 has an inverted U-shaped cross section, a horizontal top 31, and two vertical sides 32 extending from two ends of the horizontal top 31. The two vertical sides 32 are provided with a first horizontal edge 33 and a second horizontal edge. The inner slide rail 30 is fastened with the horizontal guide portion 11 of the track seat 10 in conjunction with a first roller seat 40 which is mounted between the inner slide rail 30 and the track seat 10 to reduce friction. The first roller seat 40 is provided with a first horizontal roller 43 located at one side of the horizontal guide portion 11, a second horizontal roller 42 located at other side of the horizontal guide portion 11, and a first vertical roller 41 located at the vertical flange 12. The first horizontal roller 43 is located between the horizontal top 31 and the guide portion 11. The second horizontal roller 42 is located between the guide portion 11 and the first horizontal edge 33. The first vertical roller 41 is located between the vertical flange 12 and the vertical side 32. The horizontal rollers are rollers which are mounted on the horizontal spindle. The vertical roller is the roller which is mounted on an upright spindle.

The present invention is characterized by a second roller seat 50 for joining the outer slide rail 20 and the inner slide rail 30 together, which has an inverted U-shaped cross section. The second roller seat 50 is made of a plastic material and is provided with at least one gap 53 serving to interrupt the shock transmission. The second roller seat 50 is provided in each of two vertical sides thereof with two second vertical rollers 51, and in the horizontal top side thereof with four third horizontal rollers 52. Both the outer slide rail 20 and the second roller seat 50 are mounted on the inner slide rail 30 such that the open sides of the outer slide rail 20 and the second roller seat 50 face the floor. The second vertical rollers 51 and the third horizontal rollers 52 are mounted between the outer slide rail 20 and the inner slide rail 30.

The structure of the present invention works without making noise, especially at the time when the drawer 3 is pushed back into place after being drawn out. In addition, the present invention is provided with one or more gaps 53 to reduce the effect of impact, thereby prolonging the service life span of the structure of the present invention.

As shown in FIG. 1, the present invention is further characterized by two folded flanges 35 formed at the interceptions of the horizontal top 31 and the vertical sides 32 of the inner slide rail 30, the corresponding two curves 55 provided on the two vertical sides of the second roll seat 50, and the corresponding two curves 25 provided on the two vertical sides of the outer slide rail 20. Therefore, the inertia of the drawer sliding structure as a whole will be increased remarkably compared to that without the flanges 35, the curves 55 and the curves 25, so that the deflection of the drawer sliding structure as a whole of the present invention will be reduced when the drawer is fully pulled out from a cabinet.

What is claimed is:

1. A drawer sliding structure comprising:

a track seat adapted to be fastened at one side with a panel of a cabinet, said track seat being provided with a vertical flange and a horizontal guide portion extending from one end of said vertical flange;

an outer slide rail having an inverted U-shaped cross section, a horizontal top side, two vertical sides, and an open side, with said horizontal top side being fastened with an underside of a bottom plate of a drawer of the cabinet such that said open side of said outer slide rail faces a floor;

an inner slide rail having an inverted U-shaped cross section, a horizontal top side, two vertical sides and an open side;

a first roller seat configured for fastening slidably said inner slide rail to said horizontal guide portion of said track seat such that said open side of said inner slide rail faces the floor;

a second roller seat configured for mounting said outer slide rail on said inner slide rail, said second roller seat having an inverted U-shaped cross section, a horizontal top side, two vertical sides, and an open side, with said two vertical sides being provided with at least one vertical roller, and with said horizontal top side being provided with at least one horizontal roller, so that said second roller seat is mounted on said inner slide rail with said open side of said second roller seat facing the floor, and said vertical roller and said horizontal roller are located between said outer slide rail and said inner slide rail, and further that said vertical roller and said horizontal roller provide rolling contact between said outer slide rail and said inner slide rail; and wherein two folded flanges are formed at interceptions of the horizontal top and the vertical sides of the inner slide rail, two curves corresponding to the two folded flanges are provided on the two vertical sides of the second roller seat, and two curves corresponding to the two curves of the second roller seat are provided on the two vertical sides of the outer slide rail so that the second roller seat is disposed between the inner slide rail and the outer slide rail.

2. The drawer sliding structure as defined in claim 1, wherein each of said two vertical sides of said second roller seat is provided with a plurality of vertical rollers; wherein said horizontal top side of said second roller seat is provided with a plurality of horizontal rollers.

3. The drawer sliding structure as defined in claim 1, wherein said second roller seat is made of a plastic material and is provided with at least one gap serving to interrupt transmission of shock exerting on said second roller seat.

4. The drawer sliding structure as defined in claim 1, wherein said second roller seat is made of a plastic material.

5. A drawer sliding structure comprising:

a track seat adapted to be fastened at one side with a panel of a cabinet, said track seat being provided with a vertical flange and a horizontal guide portion extending from one end of said vertical flange;

an outer slide rail having an inverted U-shaped cross section, a horizontal top side, two vertical sides, and an open side, with said horizontal top side being fastened with an underside of a bottom plate of a drawer of the cabinet such that said open side of said outer slide rail faces a floor;

an inner slide rail having an inverted U-shaped cross section, a horizontal top side, two vertical sides and an open side;

a first roller seat configured for fastening slidably said inner slide rail to said horizontal guide portion of said track seat such that said open side of said inner slide rail faces the floor;

a second roller seat configured for mounting said outer slide rail on said inner slide rail, said second roller seat having an inverted U-shaped cross section, a horizontal top side, two vertical sides, and an open side, with said two vertical sides being provided with at least one vertical roller, and with said horizontal top side being provided with at least one horizontal roller, so that said second roller seat is mounted on said inner slide rail with said open side of said second roller seat facing the floor, and said vertical roller and said horizontal roller are located between said outer slide rail and said inner slide rail, and further that said vertical roller and said horizontal roller provide rolling contact between said outer slide rail and said inner slide rail; and wherein said second roller seat is made of a plastic material and is provided with at least one gap serving to interrupt transmission of shock exerting on said second roller seat.

6. The drawer sliding structure as defined in claim 5, wherein each of said two vertical sides of said second roller seat is provided with a plurality of vertical rollers; wherein said horizontal top side of said second roller seat is provided with a plurality of horizontal rollers.

* * * * *